US007070062B2

(12) United States Patent
Trescott

(10) Patent No.: US 7,070,062 B2
(45) Date of Patent: Jul. 4, 2006

(54) AUTOMATIC RAILWAY CAR ELECTRICAL AND PNEUMATIC COUPLER

(76) Inventor: William Bernard Trescott, 8028 Hwy 457, Bay City, TX (US) 77414

( * ) Notice: Subject to any disclaimer, the term of this patent is extended or adjusted under 35 U.S.C. 154(b) by 0 days.

(21) Appl. No.: 10/870,254

(22) Filed: Jun. 18, 2004

(65) Prior Publication Data

US 2005/0279726 A1 Dec. 22, 2005

(51) Int. Cl.
*B61G 5/06* (2006.01)

(52) U.S. Cl. ..... 213/75 R; 213/1.3; 213/75 TC

(58) Field of Classification Search ..... 213/1.3, 213/75 TC, 75 R, 75 D, 78, 17, 88; 105/3
See application file for complete search history.

(56) References Cited

U.S. PATENT DOCUMENTS 1,874,228 A * 8/1932 Becker ..... 213/80
2,261,258 A * 11/1941 Kinnear ..... 213/211
3,179,473 A * 4/1965 McMillan ..... 303/1
4,765,496 A * 8/1988 Diller ..... 213/75 TC

* cited by examiner

*Primary Examiner*—Frantz F. Jules

(57) ABSTRACT

A railcar coupler which integrates fluid and electrical connectors into one modular unit with increased facility for automatically making such connections when cars are pushed together while achieving compatibility between Janney type and Automatic Intermodal Railway Car Couplers.

18 Claims, 2 Drawing Sheets

AUTOMATIC RAILWAY CAR ELECTRICAL AND PNEUMATIC COUPLER

This application claims the benefit of application Ser. No. 10/696,366.

FIELD OF THE INVENTION

This invention relates to railway vehicles, more specifically to couplers for joining a plurality of railway cars and locomotives together to form long trains.

BACKGROUND OF THE INVENTION

Couplers for connecting railway cars and locomotives together into trains are well known to those knowledgeable in the mechanical arts. The earliest couplers were simple iron chains hung between hooks attached to the ends of railway cars. Cars and locomotives using this very simple system required separate coil spring bumpers projecting from their corners to absorb the shock of impacting each other to prevent damage whenever the train stopped or slowed down. Modern Janney-type couplers, such as shown in U.S. Pat. No. 6,148,733 to Gagliardino, a variation on the Type E coupler standard on American railways since 1932, perform both the connecting and shock absorbing functions. These have a pivotal vertical knuckle adapted to engage an identical vertical knuckle on an adjacent coupler so that when the couplers are brought into contact with each other, the two knuckles are pivoted into an interlocking engaging position. The use of oil and gas filled shock absorbers to cushion the impact when cars contact each other is also well known to those knowledgeable in the art, as shown in U.S. Pat. No. 5,415,303 to Hodges.

Gagliardino teaches that to permit a railway train to safely negotiate curves in the tracks, the couplers are pivotally connected to the railway car so that, pursuant to an American Association of Railways specification, each coupler can pivot 13 degrees in a horizontal plane to either side of the longitudinal center line of the car. Therefore, to join a pair of railway cars together, it may be necessary to pivot the couplers so that they are generally aligned and directly opposed to each other. While proper straight alignment may naturally result when a pair of cars are uncoupled while on a length of straight track, there are times when they are not properly aligned for joining. For example, when a pair of cars are uncoupled while on a curved track, the couplers will not normally extend perpendicularly from the end of the railway car, making proper coupling impossible when they are later moved onto a straight track. Similarly, there are times when railway cars to be coupled together are on a length of curved track, and the coupler shanks are oriented perpendicularly from the ends of the car to be joined rather than pivoting toward each other 13 degrees for proper joining. Accordingly, it may be necessary for a conductor or trainman to manually position the couplers by pushing or pulling them into proper alignment before the cars can successfully be joined by manually moving the couplers into alignment. If attempts to join a pair of railway cars are made when the couplers are not properly aligned, the impact of misaligned couplers may cause damage to one or both couplers.

In U.S. Pat. No. 6,575,101, Blute teaches that highway truck trailers can be coupled together to form trains using a horizontally oriented V shaped member, such as found on 5th wheel turntables of highway truck tractors. These usually include a U shaped jaw that pivots around a vertically oriented pin, such as the kingpin found on highway truck semi-trailers. The V shaped member does not need to be in perfect alignment with the pin for successful coupling.

Statement of the Problem:

Advancements in transport refrigeration, hazardous material cargo monitoring, railway vehicle braking and control systems, and even national security requirements to prevent terrorism, have created a need for additional connections between railway cars such as compressed air hoses to power brakes and electrical cables to power refrigeration units, monitor access doors, or transmit data from temperature sensors. Electrically controlled anti-lock brakes, for instance, will allow railway trains to stop in a shorter distance without wearing flat spots on their steel wheels. Temperature sensors connected to the wheels will be able to detect hot wheel bearings and other potentially catastrophic maintenance problems before they occur, even on unmanned remote control trains. Because no provision for these additional fluid and electrical connections is included in existing railway car couplers, considerable manual labor is involved in attaching these additional wires and hoses and again in disconnecting them when cars are to be separated from a train. It is desired to provide a coupler that incorporates additional fluid and electrical connections and can also be operated remotely without manual adjustment or control.

It is well known in the art that fluid and electrical connectors, unlike railway couplers which are designed to be identical at each end of a railway car, work best when they are asymmetrical, such as a male plug that fits inside a female socket, or a female hose that fits over the end of a male spigot. Male to male electrical connections, such as between the pantograph of an electric trolley and overhead wires, are prone to arcing and other short circuits that are extremely destructive to computer microprocessors. Similarly, female to female fluid connections, such as the twist together glad hand connectors presently used for coupling railway car air brake hoses, are prone to leaks and require inspection, as well as manual adjustment and control. It is therefore further desired to provide a coupler having both male and female parts such that each end of a railway car can be selectively made male or female as the need arises and that both ends of a railway vehicle will be identical despite having asymmetrical parts.

Advancements in intermodal technology have made it feasible to remove railway cars from the tracks for the purpose of loading, unloading, or transport by means other than rail. Existing couplers and connectors are often very heavy and protrude from the ends of railway cars making it difficult for cranes and intermodal vehicles to lift the cars on and off the tracks. Protruding couplers take up excessive amounts of space when railway cars are placed close together on ships and barges. It is further desired to provide a coupler capable of being retracted within the body of the railway vehicle to minimize space when transported away from the railway tracks, yet will be compatible with older railway couplers already in use.

In application Ser. No. 10/696,366, I disclosed a coupler for intermodal rail vehicles having increased facility to be automatically coupled and uncoupled when an intermodal vehicle is placed upon or lifted off of railway tracks. It is therefore also further desired to provide a coupler compatible with both the Automatic Intermodal Railway Car Coupler disclosed in application Ser. No. 10/696,366 as well as older Janney type couplers.

SUMMARY OF THE INVENTION

The Automatic Railcar Electrical and Pneumatic Coupler of my invention comprises a male coupler to be attached in the rear of a railway car and a female coupler to be attached in the front of a second railway car so that when the cars are pushed together in contact with each other, they will be coupled together without damage to either car or their contents. The male coupler further comprises a horizontal shaft, which is hollow to accommodate fluid and electrical connectors, and a vertical shaft protruding underneath the horizontal shaft. The female coupler further comprises a receptacle containing fluid and electrical connectors that can be joined with those in the horizontal shaft of the male coupler such that an optional knuckle can catch and restrain the vertical shaft of the male coupler to allow the cars to be pivotally connected together. The receptacle of the female coupler is attached to the shaft of a second male coupler mounted at a right angle to the female coupler on a common pivot along the centerline of the vehicle so that the rail car can be either male or female depending on the position of the male coupler. When the male coupler is extended, the railcar is male and when the male coupler is retracted, the female coupler automatically pivots into such a position that the vehicle automatically becomes female. The receptacle of the female coupler is provided with a V shaped housing so that the horizontal shaft of a male coupler does not need to be perfectly aligned with the receptacle for successful coupling between two railcars.

DETAILED DESCRIPTION

I will now describe the preferred embodiment of my invention with reference to the accompanying drawings, wherein like numerals are used to refer to like parts.

Figures 1, 2, 3, 4, 5:
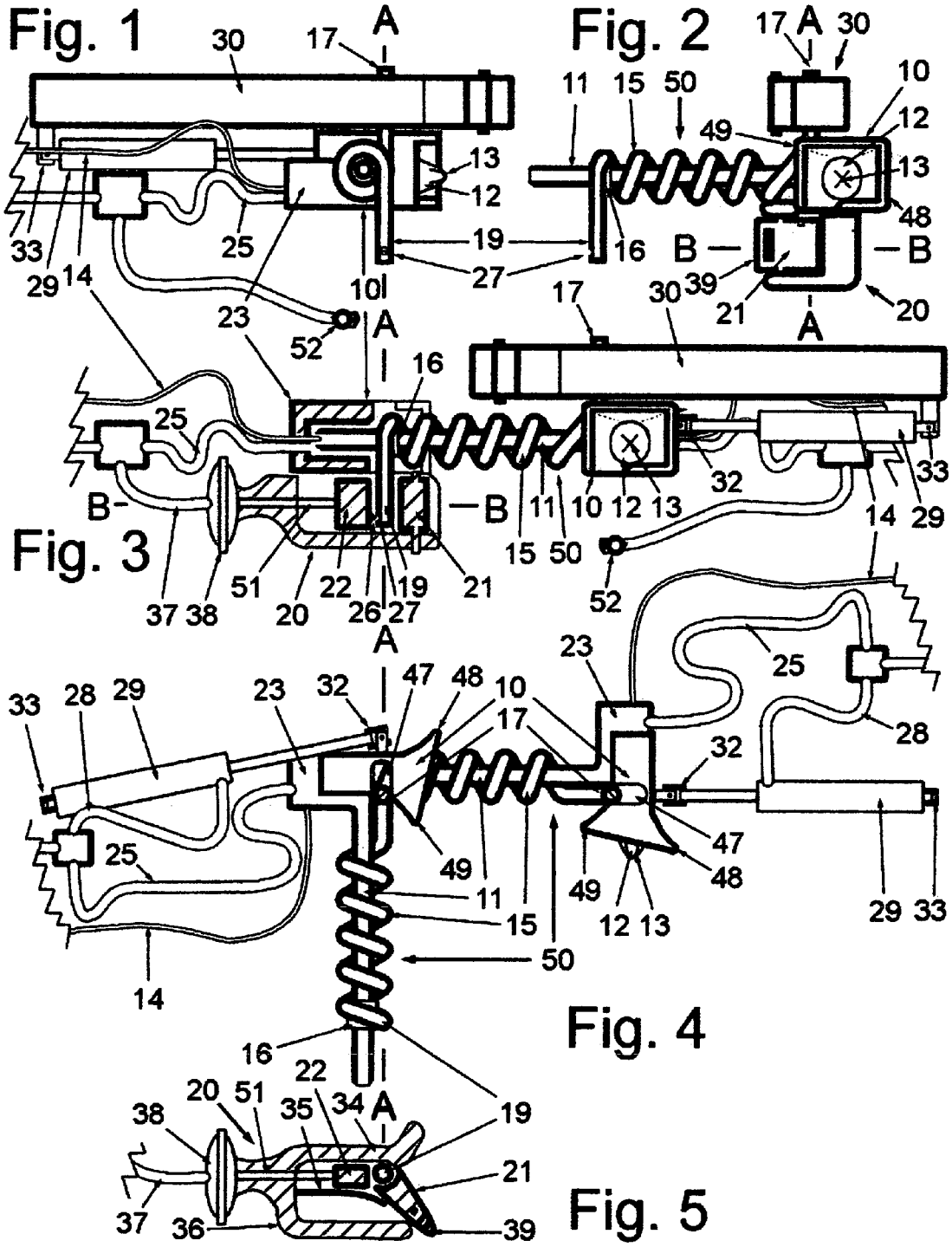
FIG. 1 is a side plan view of a Janney type railway car coupler and shank equipped with an electrical and fluid receptacle and a male coupler in retracted position according to the present invention.
FIG. 2 is a front plan view of a Janney type coupler with an electrical and fluid receptacle, a male coupler in retracted position, and a female coupler according to the present invention.
FIG. 3 is a right side cutaway view of the receptacle and female coupler of FIG. 2 at a vertical plane extending front and rear from axis A joined with a male coupler according to the present invention in extended position attached to the shank of a Janney type coupler.
FIG. 4 is a top plan view of a male coupler in retracted position with an electrical and fluid receptacle joined together with a male coupler in extended position with an electrical and fluid receptacle according to the present invention.
FIG. 5 is a top cutaway view of the female coupler of FIGS. 2 and 3 at elevation B.

FIG. 3 shows a side cut away view of a fluid and electrical receptacle 10, which is mostly cylindrical and hollow to receive a horizontal shaft 11 partially within. The horizontal shaft 11 is also hollow so it can contain a plurality of fluid and electrical connectors (not shown). The electrical connectors can be of the pin or spade types well known to those skilled in the electrical arts to be used for connecting electrical circuits of highway trailers to highway vehicles and should be attached to an electrical connector 14 projecting from the receptacle 10. Though only a pin type male electrical connector 14 is shown, one skilled in the electrical arts will recognize that a broad variety of connectors such as video and fiber optic connectors can also be used.

Due to the great variety of electrical connectors available to perform highly specialized tasks, such as connecting a plurality of computers installed in different railway cars together in a common data network, no preferred embodiment of electrical connectors is claimed in this invention, except to say that a broad variety of connectors can be accommodated. If only a single low voltage electrical connection is needed, then it is preferred that the horizontal shaft 11 be electrically isolated from the rest of the vehicle with an insulating coating so that it can engage the connector 14 directly, as shown in FIG. 3, without the need for additional connectors within.

To help guide the horizontal shaft 11 into proper position so that fluid and electrical connections can be made during a coupling operation, the receptacle 10 should have a conic or horn shaped orifice with asymmetrical wings 48, 49 which appear in the shape of a "V" when viewed from above, as shown in FIG. 4, so that the horizontal shaft 11 does not need to be perfectly aligned with the receptacle for successful coupling. It will be understood that one wing 48 protrudes farther forward than the other wing 49 to better accommodate the twists of the spring 15 and the vertical shaft 19 which will be described in greater detail below. To protect electrical connectors from dirt and corrosion when not in use and also to provide an air tight seal when the horizontal shaft 11 is engaged, the receptacle 10 should be provided with a paraboloidally shaped flexible dust boot 12 which inverts when contacted by the horizontal shaft during a coupling operation to be pushed inside the cylindrical portion of the receptacle when coupling is complete. It is well known that electrical connectors are often lubricated with electrically conductive grease which gathers dust and other contaminants, thus it is preferred that male electrical connectors, such as plugs, spades, and pins, such as the connector 14, be installed inside the boot 12 of the receptacle 10 and any female connectors, such as jacks and sockets (not shown), be installed inside the hollow horizontal shaft 11. The boot 12 is preferably made of fiber reinforced silicon rubber or a similar grease resistant plastic material with a plurality of slits 13 on its tip to allow the horizontal shaft 11 to pass through it during a coupling operation, yet return to normal position to provide a dust resistant seal when the male coupler 50 is not engaged.

It is well known to those knowledgeable in the art that the preferred working fluid for railway car brakes is compressed air, therefore in my preferred embodiment, a fluid connection completely fills the horizontal shaft 11, entirely surrounding any electrical connectors inside, thus eliminating the need for separate hoses and fluid connectors. Unless a fluid other than compressed air is used, the horizontal shaft 11 does not require a dust boot because the rapid discharge of compressed air resulting from the normal operation of railway car brakes is thought to be sufficient to prevent contamination of any electrical connectors inside. While a spring operated cap (not shown) could be fitted to the end of the shaft 11 with a tab extending from the side to open the cap when contacting the dust boot 12 during a coupling operation, and other means of obtaining an air tight seal on the receptacle 10 could also be used, such as rubber "O" rings, the paraboloidal boot 12 is the preferred method of sealing the receptacle because the discharge of compressed air from the horizontal shaft 11 when aligned with, but not connected to the receptacle, such as during an uncoupling operation, could result in contamination of any electrical contacts inside if dust protection is not provided. The dust boot 12 also allows for a looser more flexible fit between the shaft 11 and the receptacle 10 to reduce the possibility of damage to electrical connectors during coupling. It will be understood that additional fluid connections, such as a hydraulic connection (not shown), could also be included inside the receptacle 10 and horizontal shaft 11 beside any electrical connectors. Regardless of the type of fluid, the receptacle 10 should contain a valve assembly 23 to prevent working fluid from escaping through the hose 25 when the brakes of the railway car are released without a receptacle being connected to the attached horizontal shaft, or a shaft being connected to the receptacle by automatically closing off fluid flow when an excessive difference between the fluid pressure and outside atmospheric pressure is detected. Such valves are well known in the railroad industry to prevent air from escaping from an air braking system when a railway car is the last car of a train. Those knowledgeable in the art will understand that the electrical connector 14 could give the valve assembly 23 additional facility to vent pressure for rapid application of the railway car's brakes (not shown) when voltage is applied to a solenoid (not shown) inside the valve assembly 23 by remote control. This would be a design improvement over radio controlled brake valves commonly used to vent pressure from the ends of trains because air can be vented from all of the cars of a train simultaneously to achieve a shorter stopping distance while an anti-lock brake system (not shown) controls the brake pressure to prevent flat spotting of the steel railway car wheels. It is well known in the railroad industry that venting brake pressure only from the locomotive and rear car of a train without the facility to control brake pressure on individual cars often leads to flat spotting. Those knowledgeable in the art will also understand that if compressed air is to be used as the preferred working fluid, it is also preferable that a small amount of air bypass the valve assembly to keep any electrical connectors inside the unused shaft and receptacle free of dust.

Figure 6:
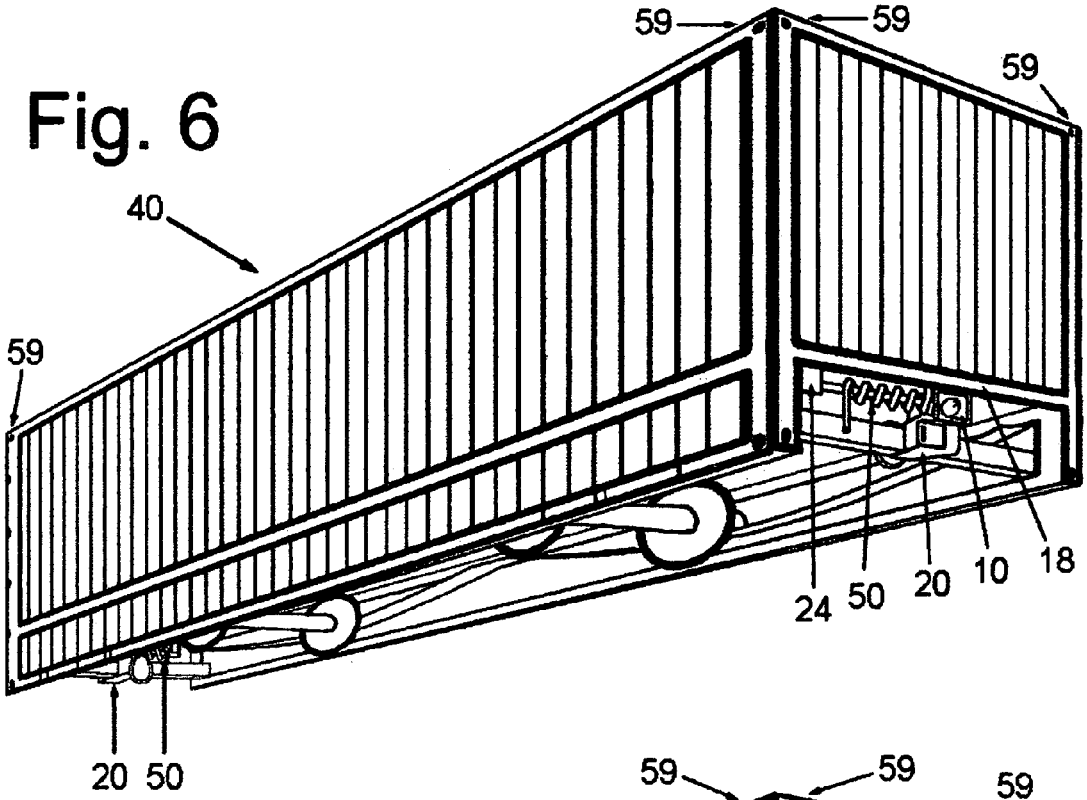
FIG. 6 is a perspective view of a portable intermodal railway vehicle having both male and female couplers according to the present invention.
Figure 7:
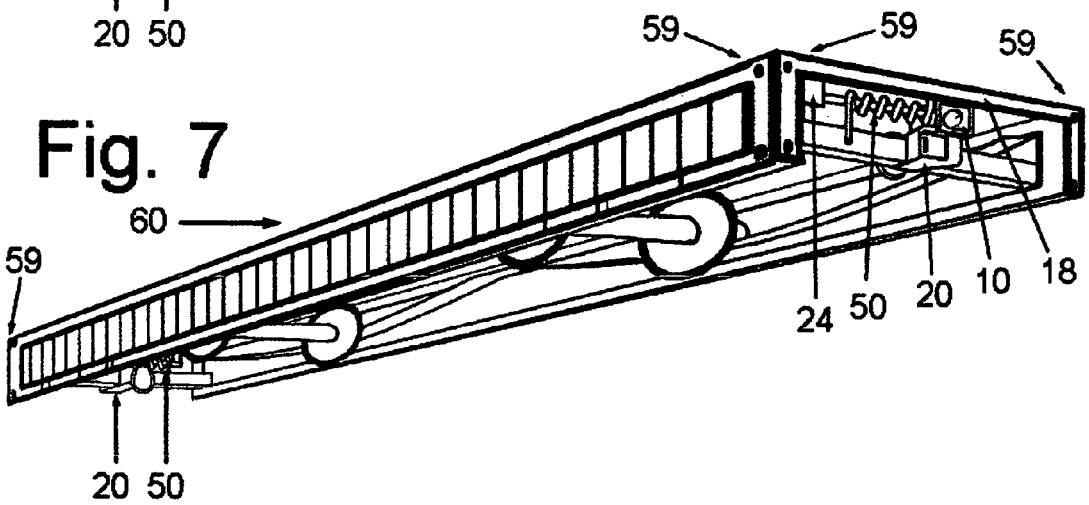
FIG. 7 is a perspective view of a portable intermodal railway vehicle having both male and female couplers according to the present invention.

FIG. 4 shows a top plan view of a male coupler 50 partially enclosed within a receptacle 10 of an adjacent coupler. The horizontal shaft 11 is rigidly attached to a shock absorbing coil spring 15 by a flange 16. The horizontal shaft 11 prevents the shock absorbing spring 15 from bending out of alignment when cars contact each other during a coupling operation, the shaft being mostly slidably attached to the spring except for the rigid attachment at the flange 16 so that the opposite end of the shaft, which is attached to another receptacle, is able to slide inside the spring and be pushed back when the spring is compressed to prevent damage to any electrical and fluid connectors inside resulting from the force of impact. The spring 15 also gives the receptacle 10 increased facility to move from side to side to prevent damage to connectors within when the horizontal shaft 11 is not in perfect alignment during coupling. One end of the spring 15 further comprises a vertical shaft 17 which is pivotally attached either to the shank 30 of a Janney type coupler as shown in FIG. 3 or a vehicle frame 18 as shown in FIG. 6 or FIG. 7. The other end of the spring 15 further comprises a second vertical shaft 19 which can be restrained by a female coupler 20 which will be described in greater detail below. Those knowledgeable in the art will recognize that because the vertical shaft 17 and the vertical shaft 19 of an adjacent coupler will share a common axis A when two couplers are joined together into one assembly as shown in FIG. 4, the helical coils of the spring 15 must be joined to the shaft 17 at such an angle that the shafts 17 and 19 of adjacent couplers do not come into contact. The bottom of the horn shaped orifice of the receptacle 10 to which the wings 48 and 49 are attached must be partially hollow as shown in FIG. 3 so as to permit the passage of the vertical shaft 19 of an adjacent coupler partially within. It is also desirable that a notch 47 be provided in the top and side of the orifice as shown in FIG. 4 to permit the passage of the vertical shaft 17 partially within should the spring 15 to which it is attached become extended in length during the acceleration of a train. It is well known in the railroad industry that couplers with slidably mounted shanks, such as most Janney type couplers, can cause cargo damage during acceleration due to the sudden jolt when a coupler shank slides outward to the limit of its scope and jerks a railcar suddenly forward. Those knowledgeable in the art will recognize that the spring 15 is a design improvement over couplers with sliding shanks because it can stretch to allow a more gradual acceleration of the railcar and that mounting the male coupler 50 and the receptacle 10 together on a common pivot avoids the problem of excessive wear on railway wheel flanges that would result if the male and female parts were mounted on separate pivots offset from the centerline of the vehicle.

FIG. 4 also shows that a hose 28 supplies fluid to a pneumatic piston 29, which is pivotally connected between both the receptacle 10 and the shank 30 as shown in FIG. 3, which applies tractive force to extend the male coupler 50 outward from the vehicle for the purpose of engaging an adjacent coupler located on an adjoining railcar. Those knowledgeable in the art will understand that other means of extending the male coupler can also be used and that such means could also be attached to parts of a railway car other than the shank 30 such as the vehicle frame 18 shown in FIGS. 6 and 7. The piston 29 may also incorporate oil and gas shock absorbing features well known to those knowledgeable in the art to increase facility to dampen the occilations of the spring 15 after a coupling operation. Because the spring 15 allows a limited amount of vertical angular movement of the horizontal shaft 11, the pivots 32 and 33 are preferably universal joints or ball joints. The piston 29 may also be fitted with an internal or external spring (not shown) to pivot the male coupler 50 through at least ninety degrees of horizontal rotation around the vertical shaft 17 when fluid is not supplied to the piston so that the attached receptacle 10 can be engaged by another male coupler mounted on a second railway car. A cap 24 can be hung from the vehicle frame 18 to engage the end of the horizontal shaft 11 when it is retracted to protect any electrical connectors inside from dust as shown in FIGS. 6 and 7.

FIG. 5 shows a top cutaway view of the female coupler 20 of FIGS. 2 and 3 at elevation B. The downward extending end of the spring 15 that comprises the vertical shaft 19 is restrained by a knuckle 21 and an anvil 22 which may further comprise semi-cylindrical surfaces to completely surround the vertical shaft 19 on axis A. Alternatively, the housing of the female coupler 20 can further comprise a wall 34 to partially surround the vertical shaft 19 on axis A. The knuckle 21 is connected to the female coupler 20 by a vertical pivot and is held closed by a spring 35 that will allow the knuckle to fold flat against the housing 36 during a coupling operation. It will be understood that although a leaf spring 35 is shown, other types of springs and flexible materials can also be used. The anvil 22 is slidably connected to the female coupler 20 so that it can be pushed back by the vertical shaft 19 during a coupling operation. When the vertical shaft 19 passes behind the folded knuckle 21, the spring 35 snaps the knuckle into its normal location as shown, restraining the vertical shaft 19. Fluid can then be supplied through the hose 37 to the piston chamber 38, which is rigidly attached to the female coupler 20 so as to actuate, by means of a connecting rod 51, linear movement of the anvil 22 to force it against the vertical shaft 19 which in turn is thrust against the knuckle 21 so that it is horizontally restrained in every direction on a plane perpendicular to axis A. The anvil 22 can also comprise a safety catch 26 capable of fitting into a notch 27 on the vertical shaft 19 to restrain the shaft in the vertical dimension. Those knowledgeable in the art will recognize that more than one knuckle could also be used and that different means of actuating the anvil 22 other than a pneumatic piston chamber can also be used. A handle 39 is provided on the knuckle 21 for manual uncoupling. As long as no fluid pressure is supplied to the piston chamber 38, a trainman can push laterally on the handle 39 to bend the spring 35 and fold the knuckle 21 against the housing 36. If fluid is supplied through the hose 25 and the hose 37 to the chamber 38 with the knuckle 21 folded against the housing 36, the anvil 22 will push the vertical shaft 19 and the male coupler 50 completely out of the female coupler 20, at the same time pulling the horizontal shaft 11, which is rigidly connected to the vertical shaft 19 by a flange 16, out of the receptacle 10, causing fluid pressure in hose 25 to be lost, which those knowledgeable in the railroad industry will understand will automatically result in the railway car brakes (not shown) being set to prevent the car from rolling after being uncoupled. Alternatively, the handle 39 can be provided with a remote control (not shown) to accomplish this task without the need for a human operator.

It is intended that the vertical shaft 19 will hang unrestrained without a female coupler if fluid and electrical connections are made according to the present invention between two Janney type couplers. Janney type couplers perform the same function as the female coupler, thus having both Janney type and female type couplers attached to the same railway car would be redundant. It is thought that only locomotives will be equipped with both a female type coupler and a Janney type coupler as shown in FIG. 2 because most railway cars lack the underlying structure on their vehicle frames needed to rigidly mount a female type coupler. It is well known that most railway locomotives have snow plows, bumpers, or cow catchers to which a female coupler can easily be attached and that most railway cars lack such features, thus it is expected that only the male coupler 50 and the female receptacle 10 will be mounted on cars with Janney type couplers and not the female coupler 20. Female couplers are to be preferred on intermodal railway vehicles intended to be lifted off of the tracks and transported by means other than by rail, such as the portable intermodal railway cars 40 and 60 shown in FIGS. 6 and 7, because they do not project outward from the ends of the vehicle in such a way as to take up excessive amounts of space when carried on ships and barges. It will be understood that the portable intermodal railway vehicle 40 in FIG. 6 has attachment points 59 similar to those of intermodal cargo containers to give it increased facility to be lifted on and off of railway tracks by the same types of cranes and equipment used for lifting intermodal containers on and off of railway cars. One knowledgeable in the art will recognize that in the event of a breakdown, maintenance defect, or other malfunction, the railcar 40 in FIG. 6 could be lifted off of the tracks and carried as cargo on the railcar 60 in FIG. 7 to ensure the on time delivery of time sensitive freight.

One skilled in the art will recognize that other methods for providing controls may be selected without departing from the teachings of this invention. It is intended that railway cars and locomotives equipped with this invention should also be equipped with computer microprocessors and sensors multiplexed together to communicate along a common data link as part of any electrical connections described above so that railway train operators will have continuous control over the status of every component of a railway train and that cars can be selectively coupled and uncoupled by remote control. It is further intended that male couplers and female receptacles be mounted on older railway vehicles having Janney type couplers so as to ensure compatibility with portable intermodal railway vehicles having only Automatic Intermodal Railway Car Couplers. An auxiliary air coupler 52 is provided as shown in FIGS. 1 and 3 to allow compatibility with older Janney type couplers not equipped with fluid and electrical receptacles according to the present invention.

Although I have now described my preferred embodiment of my invention, those skilled in the art will recognize that my invention may take other forms without departing from the spirit or teachings thereof. The foregoing description is intended, therefore, to be illustrative and not restrictive, and the scope of my invention is to be defined by the following claims:

I claim:

1. An assembly for connecting railway cars comprising a first male part and a female part said first male and female parts capable of being attached to different railcars and then combined into one assembly for the purpose of joining railcars together in a train, said first male part further comprising a vertical shaft connected to a horizontal shaft, said horizontal shaft protruding in the direction of said female part, said female part further comprising a receptacle capable of surrounding and restraining said horizontal shaft of said first male part in a plane perpendicular to said horizontal shaft, a pivotally connected second male part, said second male part further comprising a second horizontal shaft, said second horizontal shaft not protruding in the direction of said first male part.

2. The assembly for connecting railway cars of claim 1 wherein the said horizontal shaft of said first male part is hollow.

3. The assembly for connecting railway cars of claim 2 further comprising a fluid connection within said horizontal shaft of said first male part and said receptacle.

4. The assembly for connecting railway cars of claim 3 wherein said receptacle further comprises a flexible seal between said receptacle and said horizontal shaft of said first male part having the means of containing pressurized fluids within said horizontal shaft and said receptacle.

5. The assembly for connecting railway ears of claim 4 wherein said flexible seal further comprises a dust boot capable of preventing the passage of dust into said receptacle.

6. The assembly for connecting railway cars of claim 1 further comprising an electrical connection within said receptacle.

7. The assembly for connecting railway cars of claim 1 further comprising an anvil, slidably connected to said female part, capable of pushing against said vertical shaft of said first male part, a knuckle, pivotally connected to said female part, together with said anvil, capable of surrounding and restraining said vertical shaft of said first male part in a plane perpendicular to said vertical shaft on a common axis with the pivotal connection of said second male part.

8. The assembly for connecting railway cars of claim 7 wherein said knuckle further comprises a spring connected to said female part that flexibly permits said knuckle to pivot when contacted by said vertical shaft of said first male part and pivots said knuckle into a position restraining said vertical shaft of said first male part when not in contact with said vertical shaft of said first male part.

9. The assembly for connecting railway cars of claim 7 wherein said knuckle further comprises a handle for manually pivoting said knuckle.

10. The assembly for connecting railway cars of claim 7 wherein said knuckle further comprises a remote control device for pivoting said knuckle.

11. The assembly for connecting railway cars of claim 7 wherein said anvil further comprises a piston chamber connected to said female part capable of sliding said anvil such that when fluid is supplied to said piston chamber, said anvil pushes said vertical shaft of said first male part away from said female part until said horizontal shaft of said male part is not in contact with said receptacle of said female part.

12. The assembly for connecting railway cars of claim 7 wherein said anvil further comprises a safety catch capable of engaging a notch on said vertical shaft of said first male part capable of restraining the vertical movement of said first male part.

13. The assembly for connecting railway cars of claim 1 wherein said receptacle further comprises a horn shaped orifice capable of guiding said horizontal shaft of said first male part inside said receptacle.

14. The assembly for connecting railway cars of claim 1 wherein said horizontal shaft of said first male part is connected to shock absorbing spring.

15. The assembly for connecting railway cars of claim 1 wherein said horizontal shaft of said first male part is is pivotally attached.

16. The assembly for connecting railway cars of claim 15 further comprising a retraction mechanism capable of pivoting said horizontal shaft of said first male part.

17. The assembly for connecting railway cars of claim 16 wherein said retraction mechanism further comprises a spring capable of pivoting said horizontal shaft of said first male part such that said horizontal shaft is not protruding in the direction of said female part.

18. The assembly for connecting railway ears of claim 16 wherein said retraction mechanism further comprises a piston capable of pivoting said horizontal shaft of said first male part such that when fluid is supplied to said piston, said horizontal shaft of said first male part protrudes in the direction of said female part.

* * * * *